US007204450B1

(12) United States Patent
Mallory

(10) Patent No.: US 7,204,450 B1
(45) Date of Patent: Apr. 17, 2007

(54) APPARATUS FOR DISPENSING GARBAGE BAGS

(75) Inventor: Trent Hamilton Mallory, Euless, TX (US)

(73) Assignee: Olympic General Corporation, Reno, NV (US)

( * ) Notice: Subject to any disclaimer, the term of this patent is extended or adjusted under 35 U.S.C. 154(b) by 243 days.

(21) Appl. No.: 10/870,150

(22) Filed: Jun. 18, 2004

(51) Int. Cl.
*B65H 49/00* (2006.01)

(52) U.S. Cl. ..... 242/588.3; 242/593; 206/390; 221/63

(58) Field of Classification Search ..... 242/588, 242/588.3, 593; 221/63; 206/233, 494, 206/390
See application file for complete search history.

(56) References Cited

U.S. PATENT DOCUMENTS 1,901,532 A * 3/1933 Powell et al.
2,015,653 A * 10/1935 Andrews
2,017,176 A * 10/1935 Andrews
2,101,282 A * 12/1937 Piper
2,293,187 A * 8/1942 Becker
3,473,694 A * 10/1969 Dewhurst et al.
4,138,034 A * 2/1979 McCarthy
4,958,733 A * 9/1990 Masuda
5,415,320 A * 5/1995 North et al.

* cited by examiner

*Primary Examiner*—William A. Rivera
(74) *Attorney, Agent, or Firm*—Andrews Kurth LLP

(57) ABSTRACT

An apparatus for dispensing garbage bags is described herein. The apparatus includes one or more sides, a bottom, connected to the sides, and a top, connected to the sides. The top includes a slit flap and one or more hole flaps. The slit flap defines a slit. Each hole flap defines a hole and overlaps the slit flap so that the hole is centered on the slit and garbage bags are dispensed through the slit and the hole when the top is closed. The garbage bags may be dispensed, one at a time, from the center of a vertical, upright roll of garbage bags.

21 Claims, 6 Drawing Sheets

APPARATUS FOR DISPENSING GARBAGE BAGS

BACKGROUND

Garbage bags are used by millions of people everyday at home, work, school, and etcetera. Despite this continual and universal use, the multitude of available means for dispensing garbage bags leaves a lot to be desired. Such available means fail to provide an economical, efficient and easy-to-use manner of dispensing garbage bags.

Boxes of garbage bags that dispense garbage bags from a horizontal, folded-stack are one example of available means. Garbage bags are pulled from the top of the folded stack when being dispensed. Unfortunately, boxes of garbage bags typically can only hold a relatively small number of garbage bags and are, therefore, uneconomical. Moreover, often when a garbage bag is pulled out of one of these boxes, additional, unwanted garbage bags are dispensed.

Likewise, large rolls of garbage bags are awkward and difficult to handle. When attempting to get a garbage bag from the roll, the user must somehow hold the roll and tear off the garbage bag from its perforated attachment to the next garbage bag in the roll. This is especially difficult when dealing with a new roll of garbage bags. Furthermore, tearing the perforated attachment often causes one of the garbage bags to tear, ruining the bag. Additionally, due to its nature, rolls of garbage bags do not store easily. A roll of garbage bags can easily fall over and roll away, unrolling garbage bags that then have to be rolled back up.

Moreover, boxes containing horizontal rolls that dispense garbage bags from the outside of the roll exhibit many of these same problems. For example, such boxes still exhibit the problems of tearing the perforated attachment. Furthermore, the user usually must still hold the box while pulling the garbage bags as the pulling motion will tend to cause the box to move rather than the roll. This is especially true as the roll empties.

Today's consumers, whether at home, work or elsewhere, demand better means for dispensing their garbage bags. These consumers want efficient, economical, and easy-to-use means for dispensing garbage bags.

SUMMARY

An advantage of the embodiments described herein is that they overcome the disadvantages of the prior art. Another advantage of certain embodiments is that they provide an easily storable, convenient, efficient, economical, and easy to use means for dispensing garbage bags.

These advantages and others are achieved by an apparatus for dispensing garbage bags. The apparatus includes one or more sides, a bottom, connected to the sides, and a top, connected to the sides. The top includes a slit flap and one or more hole flaps. The slit flap defines a slit. Each hole flap defines a hole and overlaps the slit flap so that the hole is centered on the slit and garbage bags are dispensed through the slit and the hole when the top is closed. The garbage bags may be dispensed, one at a time, from the center of a vertical, upright roll of garbage bags.

These advantages and others are also achieved by an apparatus for dispensing garbage bags. The apparatus includes four rectangular sides, a bottom, connected to the four rectangular sides, and a top, connected to the sides. The top includes a slit flap and three hole flaps. The slit flap defines a slit. Each hole flap defines a hole and overlaps the slit flap so that the holes are centered on the slit and garbage bags are dispensed through the slit and the holes when the top is closed. The garbage bags may be dispensed, one at a time, from the center of a vertical, upright roll of garbage bags.

These advantages and others are also achieved by an apparatus for dispensing garbage bags. The apparatus includes one or more sides, a bottom, connected to the sides, and a top, connected to the sides. The top includes means for dispensing garbage bags from a center of a roll of garbage bags through a center of the top. The garbage bags may be dispensed, one at a time, from the center of a vertical, upright roll of garbage bags.

These advantages and others are also achieved by an apparatus for dispensing garbage bags. The apparatus includes one or more sides, a bottom, connected to the sides, a top, connected to the sides, and a roll of garbage bags, vertically oriented so that a center of the roll of garbage bags faces the top. The garbage bags are dispensed, one at a time, from the center of the roll of garbage bags through the top.

DESCRIPTION OF THE DRAWINGS

The detailed description will refer to the following drawings, wherein like numerals refer to like elements, and wherein.

DETAILED DESCRIPTION

Embodiments of an apparatus for dispensing garbage bags are described herein. Although described herein in terms of dispensing garbage bags, the apparatus may be used to dispense other type of bags as well.

With reference now to FIGS. 1A–1D, shown is an apparatus 10 for dispensing garbage bags. The apparatus 10 shown is a box, although other containers may work as well. The box may be, for example, a six-sided box, e.g., with square and/or rectangular sides, or a box of a different shape, e.g., a cylindrical. The apparatus 10 may be made, for example, from corrugated cardboard or other materials, although the material should have sufficient strength and durability to withstand wear and tear from use. The apparatus 10 contains a supply of garbage bags in the apparatus 10 interior and dispenses the garbage bags. The supply of garbage bags is generally oriented in a vertical, upright position.

Figure 1B:
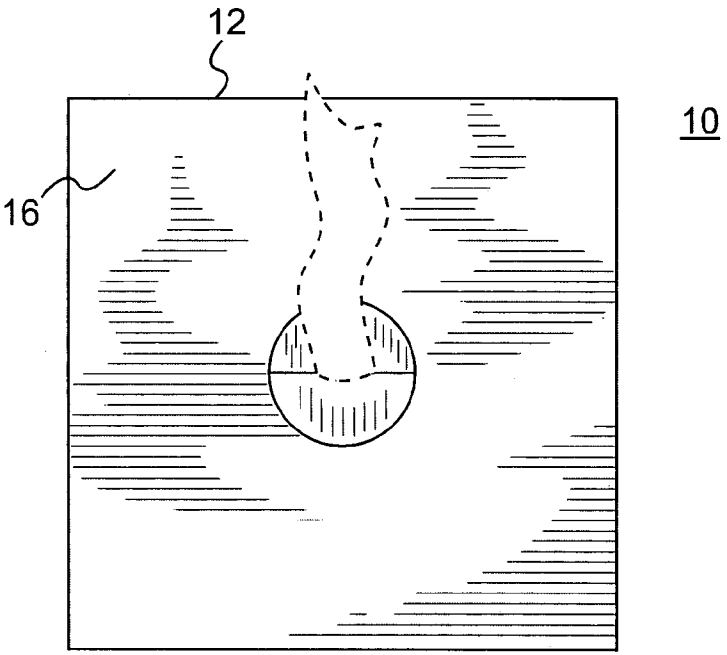
FIG. 1B is a diagram illustrating a top view of an embodiment of an apparatus for dispensing garbage bags.
Figure 1A:
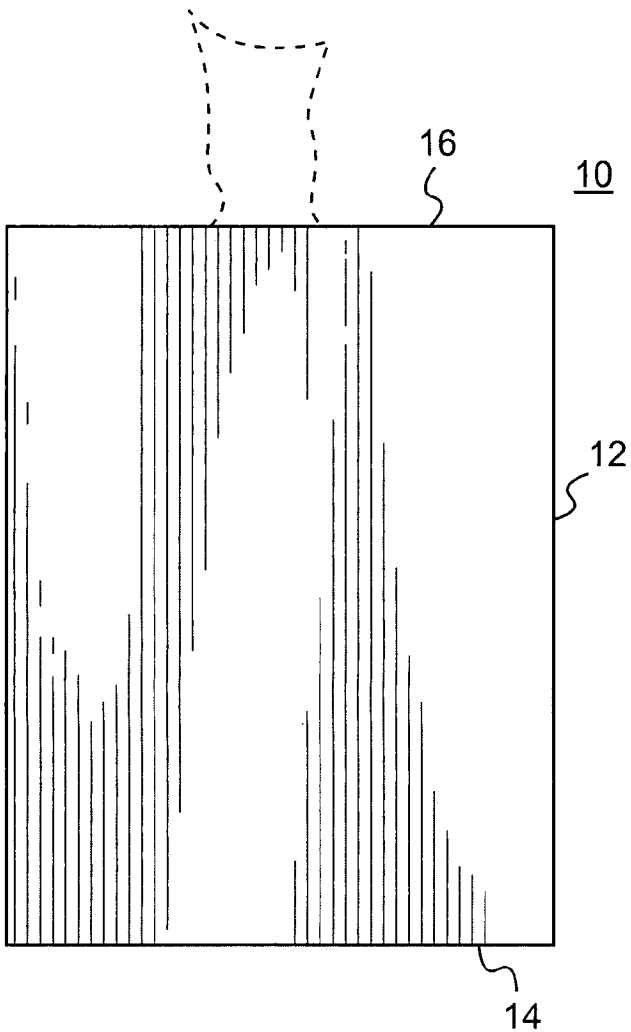
FIG. 1A is a diagram illustrating a side view of an embodiment of an apparatus for dispensing garbage bags.
Figure 1C:
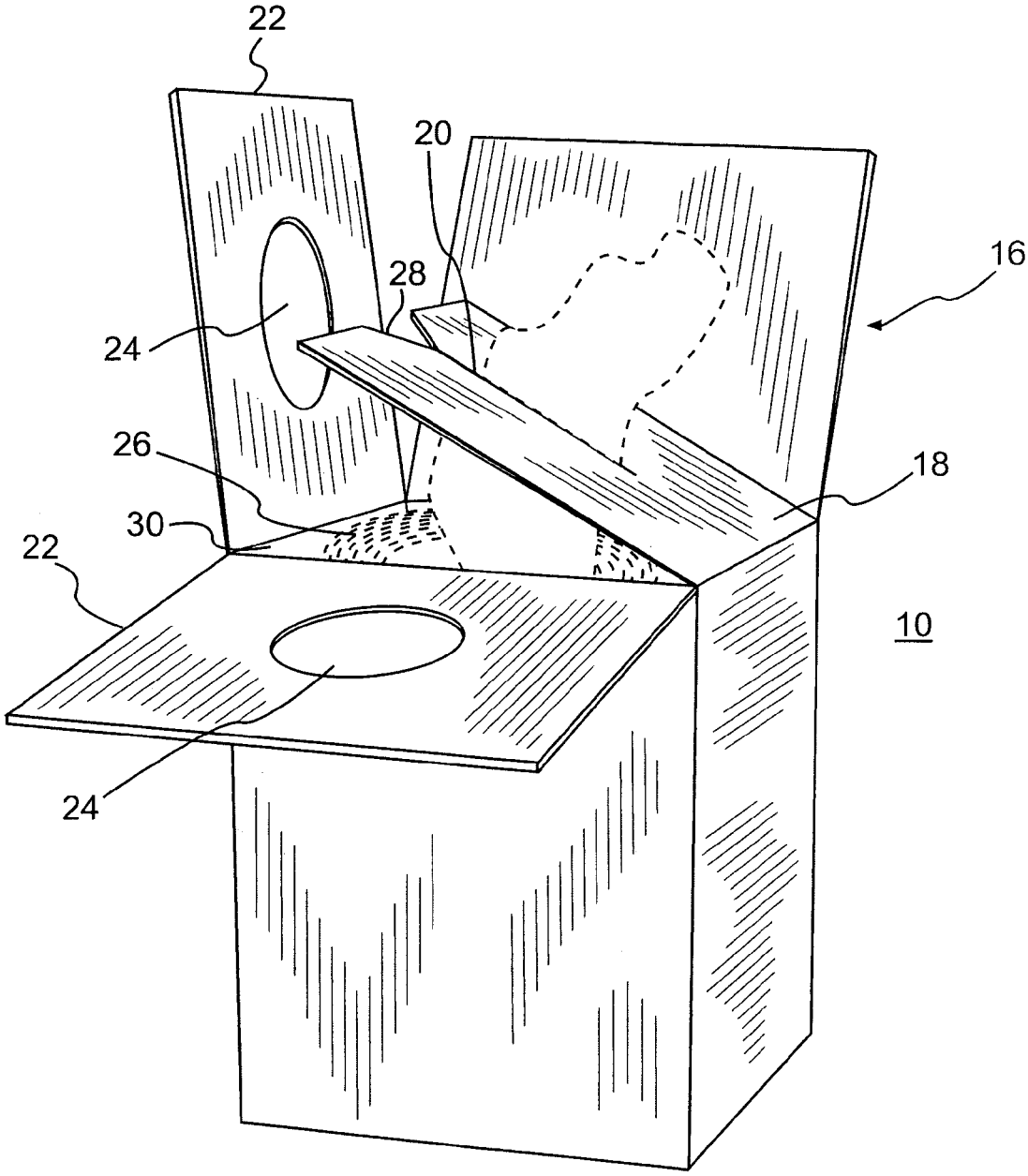
FIG. 1C is a diagram illustrating a side perspective view of an embodiment of an apparatus for dispensing garbage bags with a top of the apparatus open.
Figure 1D:
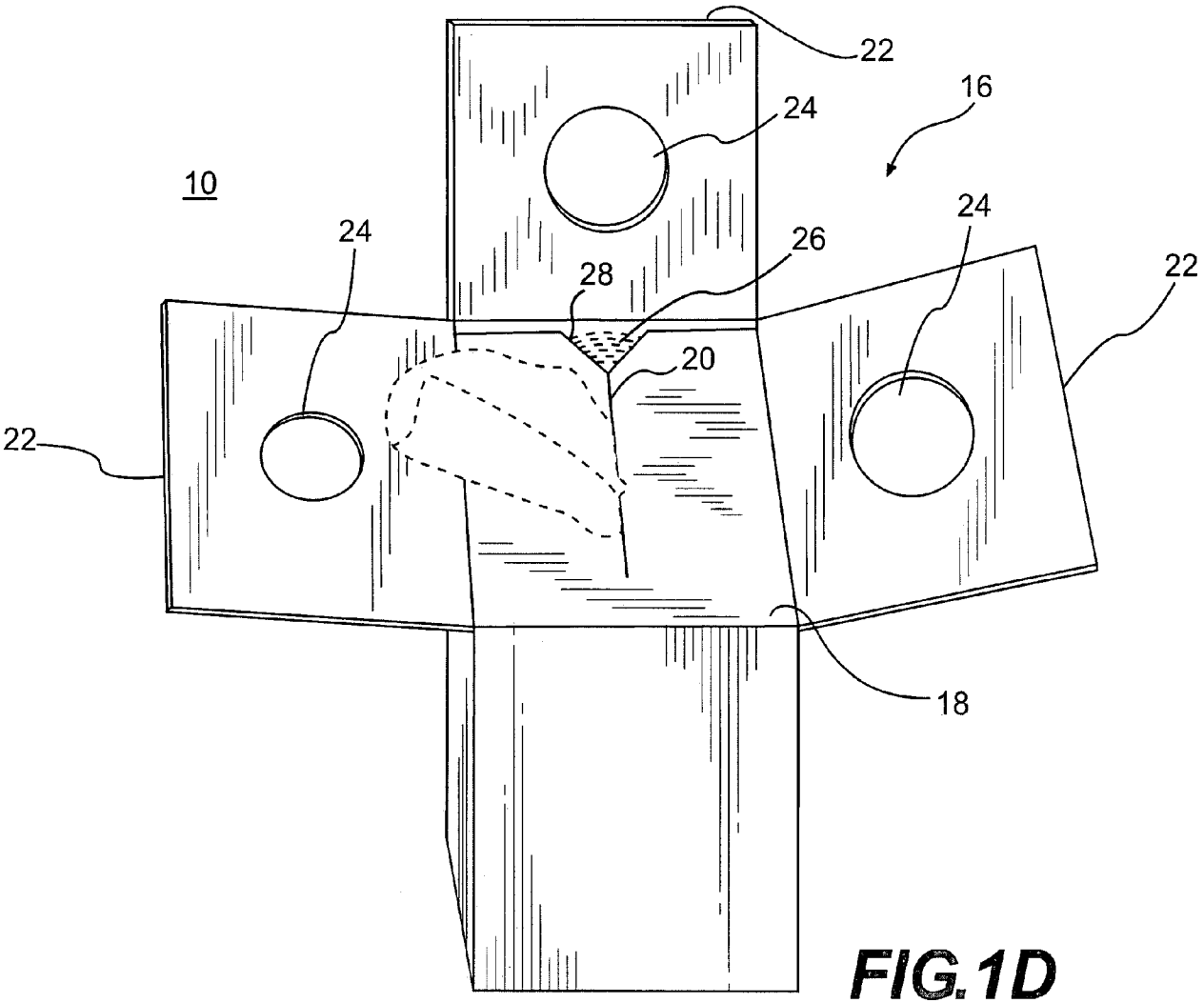
FIG. 1D is a diagram illustrating a top perspective view of an embodiment of an apparatus for dispensing garbage bags with a top of the apparatus open.

The apparatus 10 includes four sides 12, a bottom 14 (not shown), and a top 16. With reference to FIGS. 1C and 1D, the top 16 includes a plurality of flaps. The top 16 shown includes a flap 18 with a slit 20 and three additional flaps 22 with circular holes 24. When the top 16 is closed, the three flaps 22 with holes 24 are positioned overlapping on top of the flap 18 with a slit 20 and the holes 24 are generally centered on top of the slit 20. Garbage bags from the garbage bag supply 26 contained in the apparatus 10 are dispensed through the slit 20 and the holes 24 in the top 16 of the apparatus 10.

The flap 18 with a slit 20 may also include a notch 28, as seen in FIG. 1D. The notch 26 may be v-shaped, with the wide part of the notch 28 facing away from the center of the flap 18. The notch 28 enables garbage bags to be more easily inserted into the slit 20, in affect funneling the garbage bag into the slit 20. The slit 20 then helps to control the garbage bag as the garbage bag is dispensed from apparatus 10. The slit 20 also helps to prevent more than one garbage bag from being dispensed at a time.

With continuing reference to FIGS. 1C and 1D, the hole 24 in one of the flaps 22 is smaller than the holes 24 in the other two flaps 22. As shown in FIGS. 1A and 1B, the flap 22 with the smaller hole 24 is preferably the top-most flap 22 when the top 16 is closed. In this manner, the larger holes 24 and the smaller 24 provide a funneling or channeling affect, helping to control the lateral movement of the garbage bag as the garbage bag is being dispensed from the apparatus 10. The control provided by the holes 24 and the slit 20 enable a smooth and continuous supply of garbage bags from the apparatus 10.

The garbage bag supply 26 is contained in the interior cavity 30 formed by the sides 12, bottom 14, and top 16 of the apparatus 10. The garbage bag supply 26 may be a roll of garbage bags. The roll of garbage bags is oriented in a vertical, upright position with the center of the garbage bag roll facing the top 16 of the apparatus 10. The garbage bags dispensed by the apparatus 10 are pulled from the center of the garbage bag roll, one garbage bag at a time. Pulling the garbage bags from the center of the garbage bag roll through the slit 20 and the holes 24 provides a smooth and continuous supply of garbage bags from the apparatus 10. The center of the garbage bag roll is directly underneath the slit 20 and the holes 24. Pulling the garbage bags from the center generally also avoids rotating the garbage bag roll, as would happen if the garbage bags were pulled from the exterior of the garbage bag roll. Moreover, by orienting the roll of garbage bags in a vertical, upright position and pulling the garbage bags from the center of the garbage bag roll, gravity assists in holding and controlling the apparatus 10. Gravity exerts a force directly opposite the pulling motion exerted by pulling the garbage bag from the center of the vertical, upright garbage bag roll. Due to the affect of gravity, the user generally does not have to hold the apparatus 10 when dispensing garbage bags, therefore enabling the user to dispense bags with one hand.

The garbage bags in the garbage bag supply 26 shown overlap with one another, but are not connected together by perforations, or otherwise. In this manner, when one garbage bag is completely dispensed from the apparatus 10, the start of another garbage bag should extend outside of the top-most hole 24. Consequently, the garbage bags are dispensed one garbage bag at a time. If the garbage bags become misaligned or otherwise do not dispense properly, it is a simple matter to open the top 16 and re-thread the next garbage bag from the garbage bag supply 26 through the notch 28 and into the slit 20 and through the holes 24. Alternatively, the garbage bags may be connected together through perforated connections or otherwise.

Figure 2A:
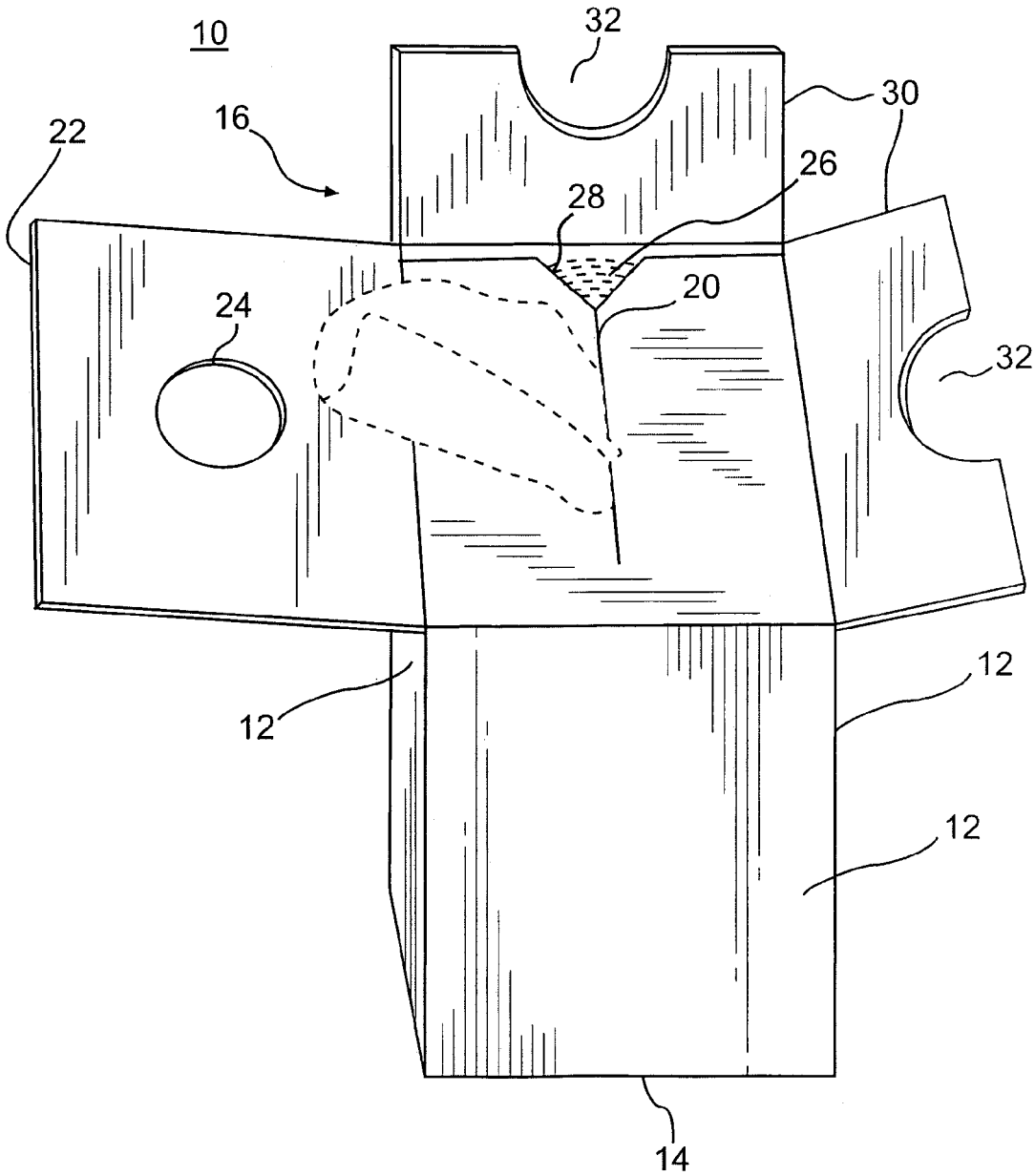
FIG. 2A is a diagram illustrating a top perspective view of another embodiment of an apparatus for dispensing garbage bags with a top of the apparatus open
Figure 2B:
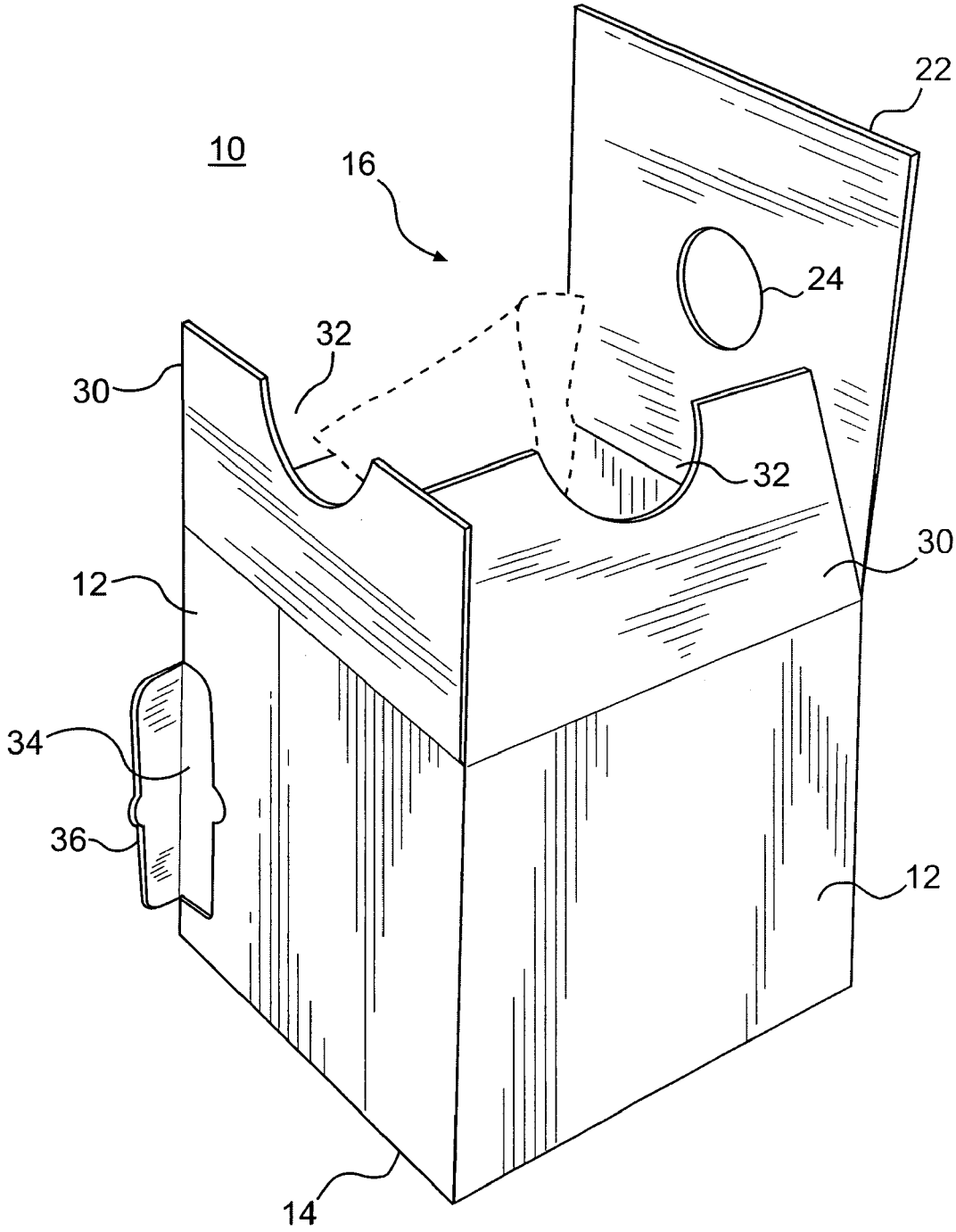
FIG. 2B is a diagram illustrating a side perspective view of another embodiment of an apparatus for dispensing garbage bags.

With reference now to FIGS. 2A and 2B, illustrated are another embodiment of the apparatus 10 for dispensing garbage bags. The apparatus 10 shown also includes four sides 12, a bottom 14, and a top 16. However, as seen in FIG. 2A, the top 16 includes two half flaps 30, which are approximately halved flaps 22 and, therefore, include half-holes 32 (in this embodiment, semi-circular openings). As above, the flap 22 with the smaller hole 24 is preferably the top-most flap 22 when the top 16 is closed. The two half flaps 30 with the half-holes 32 serve the same purpose as the flaps 22 with holes 24, helping to control the lateral movement of the garbage bags and funneling or channeling the garbage bags as the garbage bags are dispensed. While the half-flaps 30 with half-holes 32 may sacrifice some minimal control, a reduced material cost is achieved as less material (e.g., corrugated cardboard) is needed to construct the half flaps 30.

With reference now to FIG. 2B, shown is an opening 34 in one of the sides 12 of the apparatus 10. The opening 34 allows for the storage and retrieval of garbage bag ties, or other helpful items, in the interior of the apparatus 10. The opening 34 may also be used as a handle for easy carrying of the apparatus 10. The opening 34 may include a cover 36. The cover 36 may include a tab, latch, or other device (not shown) to keep the cover closed over the opening 34. The cover 36 helps to prevent the garbage bag ties, or other items, from falling out of the opening 34.

The apparatus 10 may be sized to fit any size garbage bag supply (e.g., garbage bag roll) and any size garbage bags. For example, a side-by-side comparison of FIGS. 1A–1D and FIGS. 2A–2B shows that the embodiment in FIGS. 1A–1D are slightly taller than the embodiment in FIGS. 2A–2B. Wider embodiments may also be provided in order to accommodate larger garbage bag supplies.

The apparatus 10 may also include additional features beyond those illustrated herein. For example, one of the flaps 22 and/or sides 12 may include a latch or other device that keeps the top 16 closed. Likewise, the ordinarily open end of one of the flaps 22 may be glued or otherwise fixably connected to one of the sides 12 so that the top 16 is fixably closed. In addition or alternatively to the opening 34, the apparatus 10 may also include a handle that eases carrying and transportation of the apparatus 10.

Figure 3:
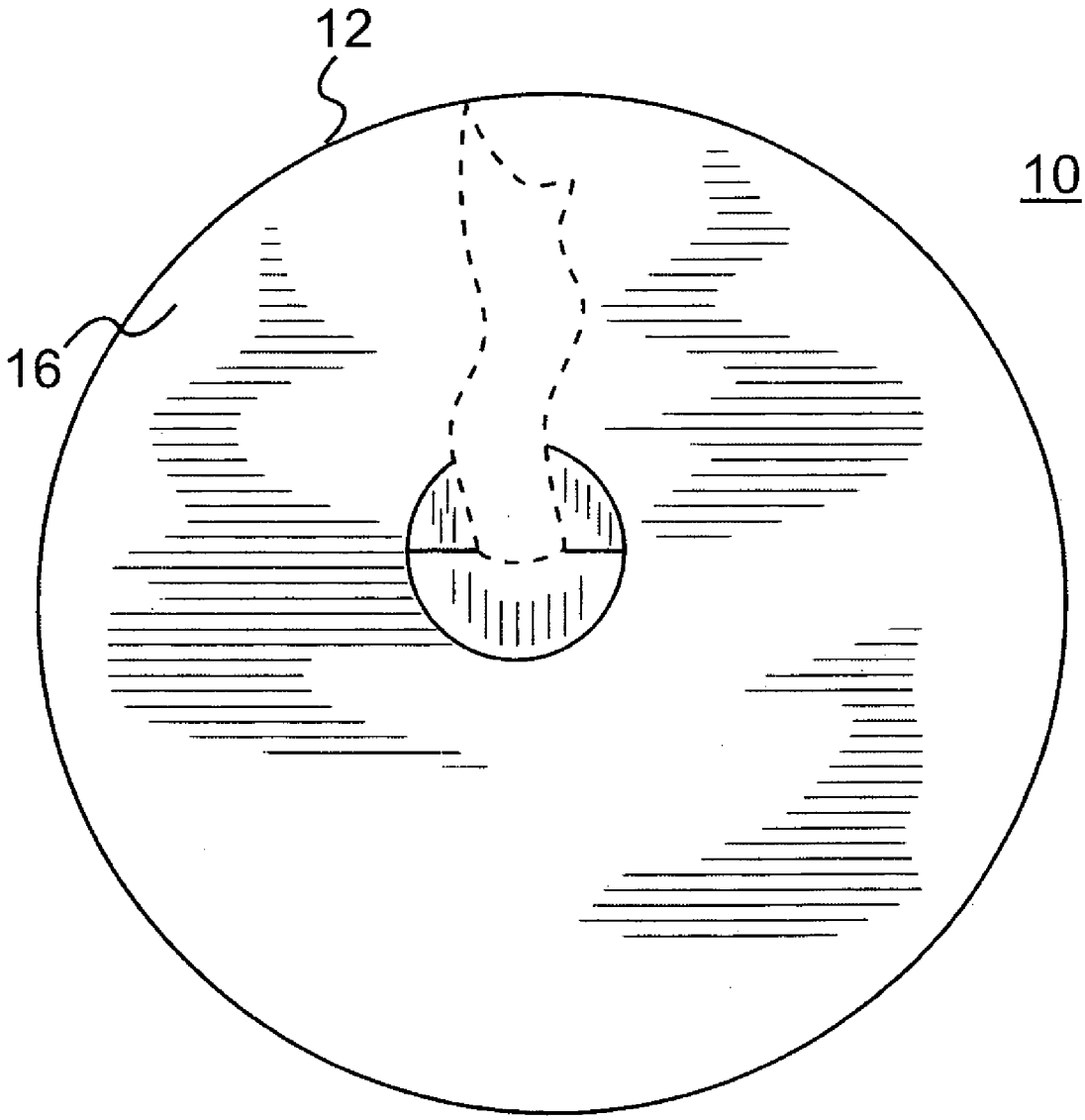
FIG. 3 is a diagram illustrating a top view of another embodiment of an apparatus for dispensing garbage bags.

With reference now to FIG. 3, shown is a cylindrical embodiment of the apparatus 10 for dispensing garbage bags. In the embodiment shown, sides 12 of apparatus 10 are cylindrical. Indeed, sides 12 may be formed as one continuous piece (e.g., one side 12). Also as shown, bottom 14 and top 16 are circular, fitting with cylindrical sides 12.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated.

The invention claimed is:

1. An apparatus for dispensing garbage bags comprising:
one or more sides;
a bottom, connected to the sides; and
a top, connected to the sides, including:
a slit flap, wherein the slit flap defines a slit; and
three hole flaps, wherein each hole flap defines a hole and overlaps the slit flap so that the hole is centered on the slit and garbage bags are dispensed through the slit and the hole when the top is closed, wherein two of the three hole flaps define a hole that is smaller than the hole defined by the third hole flap.

2. The apparatus of claim 1 wherein the third hole flap overlaps the two hole flaps with the smaller hole when the top is closed.

3. The apparatus of claim 1 wherein the one or more sides, the bottom and the top define an interior cavity, the interior cavity containing a supply of garbage bags.

4. The apparatus of claim 3 wherein the garbage bag supply is a roll of garbage bags vertically oriented in the interior cavity so that a center of the roll of garbage bags faces the top.

5. The apparatus of claim 4 wherein the garbage bags are dispensed from the center of the roll of garbage bags through the slit and the hole one garbage bag at a time.

6. The apparatus of claim 1 comprising four sides.

7. An apparatus for dispensing garbage bags comprising:
one or more sides;
a bottom, connected to the sides; and
a top, connected to the sides, including:
a slit flap, wherein the slit flap defines a slit; and
one or more hole flaps, wherein each hole flap defines a hole and overlaps the slit flap so that the hole is centered on the slit and garbage bags are dispensed through the slit and the hole when the top is closed, the one or more hole flaps include three hole flaps and two of the three hole flaps are half-flaps.

8. The apparatus of claim 7 wherein the one or more sides, the bottom and the top define an interior cavity, the interior cavity containing a supply of garbage bags.

9. The apparatus of claim 8 wherein the garbage bag supply is a roll of garbage bags vertically oriented in the interior cavity so that a center of the roll of garbage bags faces the top.

10. The apparatus of claim 9 wherein the garbage bags are dispensed from the center of the roll of garbage bags through the slit and the hole one garbage bag at a time.

11. The apparatus of claim 7 comprising four sides.

12. The apparatus of claim 7 wherein the half-flaps define semi-circle openings.

13. The apparatus of claim 7 wherein the hole is circular.

14. The apparatus of claim 7 wherein the slit flap further defines a notch.

15. The apparatus of claim 7 wherein one of the one or more sides defines an opening, the opening providing access to an interior defined by the one or more sides, the bottom and the top.

16. The apparatus of claim 15 wherein the opening includes a cover that can close the opening.

17. The apparatus of claim 7 wherein the one or more sides is a cylindrical side.

18. The apparatus of claim 7 wherein the one or more sides are cubical sides.

19. The apparatus of claim 7 wherein the one or more sides are corrugated cardboard.

20. An apparatus for dispensing garbage bags comprising:
one or more sides;
a bottom, connected to the sides; and
a top, connected to the sides, including:
a slit flap, wherein the slit flap defines a slit and a notch, wherein the notch is a v-shaped notch with a wide part of the v-shaped notch facing away from the slit; and
one or more hole flaps, wherein each hole flap defines a hole and overlaps the slit flap so that the hole is centered on the slit and garbage bags are dispensed through the slit and the hole when the top is closed.

21. The apparatus of claim 20 wherein the top includes three hole flaps.

* * * * *